US012134501B2

(12) United States Patent
Pries et al.

(10) Patent No.: US 12,134,501 B2
(45) Date of Patent: Nov. 5, 2024

(54) FLAP CLOSURE

(71) Applicant: WEENER PLASTIK GMBH, Weener (DE)

(72) Inventors: Holger Pries, Leer (DE); Michael Schipper, Weener (DE); Jens Brauer, Leer (DE)

(73) Assignee: Weener Plastik GmbH, Weener (DE)

( * ) Notice: Subject to any disclaimer, the term of this patent is extended or adjusted under 35 U.S.C. 154(b) by 709 days.

(21) Appl. No.: 17/256,046

(22) PCT Filed: Jul. 4, 2018

(86) PCT No.: PCT/EP2018/068148

§ 371 (c)(1),
(2) Date: Mar. 22, 2021

(87) PCT Pub. No.: WO2020/007465

PCT Pub. Date: Jan. 9, 2020

(65) Prior Publication Data

US 2021/0292053 A1 Sep. 23, 2021

(51) Int. Cl.
*B65D 47/08* (2006.01)

(52) U.S. Cl.
CPC ..... *B65D 47/0814* (2013.01)

(58) Field of Classification Search
CPC ..... B65D 47/0814; B65D 43/169
(Continued)

(56) References Cited

U.S. PATENT DOCUMENTS 4,414,705 A 11/1983 Ostrowsky
4,487,324 A 12/1984 Ostrowsky
(Continued)

FOREIGN PATENT DOCUMENTS

CA 1230839 12/1987
CH 653639 1/1986
(Continued)

OTHER PUBLICATIONS

Official Action with machine translation for Russia Patent Application No. 2021101971/11 OA dated Jun. 15, 2021, 10 pages.
(Continued)

*Primary Examiner* — Robert J Hicks
*Assistant Examiner* — Sanjidul Islam
(74) *Attorney, Agent, or Firm* — Sheridan Ross P.C.

(57) ABSTRACT

The invention relates to a flap closure comprising a closure body (1) and a flap cover (2), which are connected to one another via at least one hinge (9) and via at least one tensioning band (10) in order to achieve a snap-effect when opening and/or closing the flap cover. In the unloaded state, in a cross-section perpendicular to the axis of rotation of the at least one hinge, the at least one tensioning band (10) has at least three curved sections and a substantially straight section between two respective neighbouring curved sections, as well as not curving in opposing directions. Alternatively, in the unloaded state of the at least one tensioning band (10), in a cross-section perpendicular to the axis of rotation of the hinge, the distance from a tangent at a central line between the edges of the at least one tensioning band at a connection point of the tensioning band with the closure body or with the flap cover to the axis of rotation of the at least one hinge (9) is max. three times the size, preferably max. twice the size, more preferably max. the same size and particularly preferably max. 0.5 times the size of the thickness of the at least one tensioning band at the respective connection point. As a result, a breaking or tearing of the tensioning band rarely occurs.

4 Claims, 4 Drawing Sheets

Figure 1:
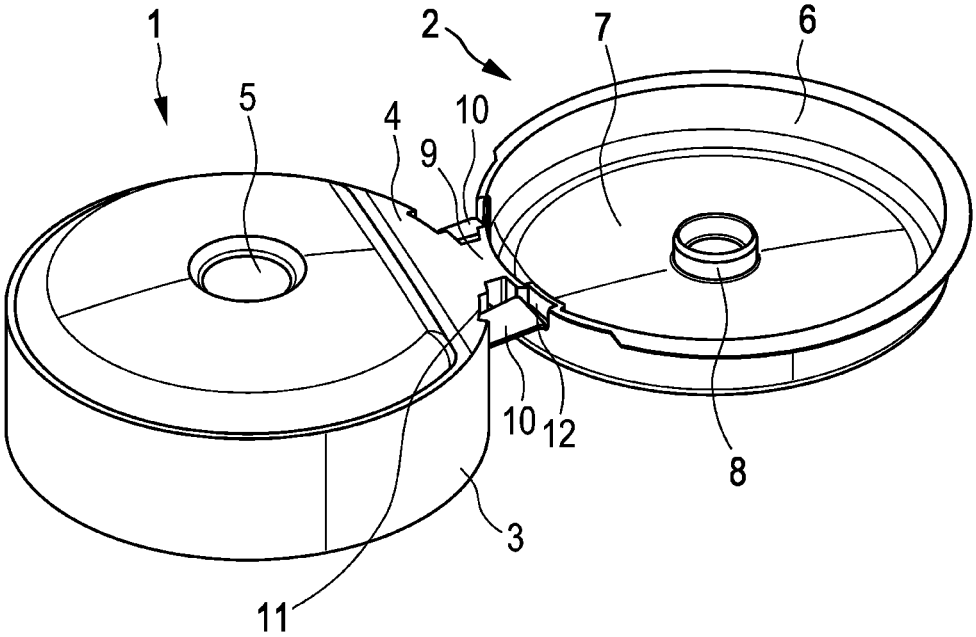
Fig. 1 (Prior Art)

(58) Field of Classification Search
USPC ..... 215/235
See application file for complete search history.

(56) References Cited

U.S. PATENT DOCUMENTS

| | | | | |
|---|---|---|---|---|
| 4,696,408 | A | 9/1987 | Dubach | |
| 4,854,473 | A | 8/1989 | Dubach | |
| 5,435,456 | A | 7/1995 | Dubach | |
| 5,489,035 | A * | 2/1996 | Fuchs | B65D 47/0814 215/237 |
| 5,785,193 | A * | 7/1998 | Kobayashi | B65D 47/0814 215/237 |
| 2010/0276460 | A1 | 11/2010 | Domoy et al. | |
| 2011/0000137 | A1 | 1/2011 | Druitt et al. | |

FOREIGN PATENT DOCUMENTS

| | | |
|---|---|---|
| CO | 6361977 | 1/2012 |
| DE | 3345509 | 5/1985 |
| DE | 4335107 | 4/1995 |
| EP | 0208413 | 1/1987 |
| EP | 0291457 | 11/1988 |
| EP | 0873944 | 10/1998 |
| GB | 2524480 | 9/2015 |
| JP | 2005-350139 | 12/2005 |

OTHER PUBLICATIONS

Official Action with machine translation for Russia Patent Application No. 2021101971/11, dated Nov. 3, 2021, 8 pages.
English Translation of the International Search Report for International (PCT) Patent Application No. PCT/EP2018/068148, dated Mar. 26, 2019, 2 pages.
International Search Report and Written Opinion for International (PCT) Patent Application No. PCT/EP2018/068148, dated Mar. 26, 2019, 9 pages.
Third Party Observation for International (PCT) Patent Application No. PCT/EP2018/068148, dated Nov. 3, 2020, 21 pages.
Applicant Response to Third Party Observations for International (PCT) Patent Application No. PCT/EP2018/068148, dated Dec. 11, 2020, 3 pages.
Official Action with Machine Translation for Brazil Patent Application No. BR112020026723-6, dated Apr. 15, 2023, 7 pages.
Official Action with Informal Translation for Brazil Patent Application No. BR112020026723-6, dated Jul. 21, 2022, 5 pages.
Official Action with machine translation for Colombia Patent Application No. NC2021/0000648, dated Aug. 12, 2022, 15 pages.
Official Action with machine translation for European Patent Application No. 18742420.5, dated Apr. 22, 2022, 9 pages.
Official Action for India Patent Application No. 202117003346, dated Apr. 20, 2022, 6 pages.
English Translation of the International Preliminary Report on Patentability for International (PCT) Patent Application No. PCT/EP2018/068148, dated Jan. 5, 2021, 6 pages.
Official Action with Partial English Translation for Mexico Patent Application No. MX/a/2020/014324, dated Jan. 26, 2024, 12 pages.

* cited by examiner

FLAP CLOSURE

CROSS REFERENCE TO RELATED APPLICATIONS

This application is a national stage application under 35 U.S.C. § 371 and claims the benefit of PCT Application No. PCT/EP2018/068148 having an international filing date of 4 Jul. 2018, which designated the United States, the disclosure of which is incorporated herein by reference.

DESCRIPTION

The present invention relates to a flap closure comprising a closure body and a flap cover connected to one another by at least one hinge and at least one tensioning band in order to achieve a snap-effect when opening and/or closing the flap cover.

The snap closure is preferably made of plastic, particularly by injection molding. In this case, the closure body and the flap cover inclusive of the at least one hinge and the at least one tensioning strap can be injection molded together; i.e. in one piece. It is however also possible to first injection mold one component, in particular the closure body, and then inject the other components onto it, in particular the flap cover with the at least one hinge and the at least one tensioning strap. Conversely, the flap cover can also be injection molded first and the closure body then molded onto it. In both cases, the at least one hinge and the at least one tensioning band can be injection molded together with the closure body or together with the flap cover.

The injection position of the flap closure; i.e. the position in which the closure body and the flap cover are injected together or injected onto one another respectively, is preferably a position of the flap cover open approximately 180 degrees. Since the flap closure is originally cast in this position, no mechanical forces act on its individual components in this position. In particular, the at least one tensioning band is thus unloaded in the injection position; i.e. not subject to any tensile or bending stresses or other mechanical forces.

The at least one hinge is preferably designed as a living hinge; i.e. a thin segment in the material along a line which corresponds to the hinge's axis of rotation. The hinge function thereby results from the material's increased flexibility at this thin segment.

By the flap cover pivoting about the axis of the at least one hinge, the flap cover can be brought into at least one, in particular fully closed position and into at least one open position.

The closure body preferably comprises an opening for dispensing a product which is covered, preferably tightly sealed, by the flap cover in its closed position.

The closure body is designed to be attached to a container, in particular to a bottle, particularly by being screwed or snapped on. Flap closures of the type considered are used to dispense a multitude of liquid, pasty, powdery, granular, lumpy or otherwise flowable or pourable products from the container, e.g. for personal care or other care products, cosmetics, oils or fats, cleaning agents, medicines, foodstuffs or beverages.

When the closure body is attached to the container, the flap cover can preferably be opened with a single finger, preferably the thumb, and snaps into a stable open position upon overcoming a specific opening angle, the "snap-over angle." In this open position, the flap cover is then not in the way when the product is being dispensed from the container.

Particularly when the container is used as a drinking bottle, the flap cover does not impede the user's drinking by coming into contact with the user's mouth or nose.

Conversely, the flap cover can be closed from its open position, preferably again with just a single finger, and preferably snaps back again into the fully closed or a nearly closed position upon overcoming a specific opening angle, again in particular the snap-over angle, whereby it can preferably be brought from the nearly closed position into the fully closed position upon being pressed again with the finger.

The cited snap effect is achieved by the at least one tensioning band being arranged so as to only be slightly taut in the closed position of the flap cover, gradually tensioning upon the flap cover being opened until reaching its maximum tension at the snap-over angle, and then constricting again and thus slackening upon the further opening of the flap cover after overcoming the snap-over angle. Preferably, the corresponding procedure also ensues in reverse when the flap cover is closed such that the aforementioned snap-effect also thereby occurs.

To achieve the snap-effect, the connection points of the tensioning band to the closure body or to the flap cover respectively are usually arranged lower than the axis of rotation of the hinge (in the fully open position of the flap cover). This is based on the orientation of the flap closure having the closure body situated below the flap cover in the flap cover's fully closed position.

In the fully closed position of the flap cover, the connection points of the tensioning band to the closure body or to the flap cover respectively then preferably lie one above the other vertically so that the tensioning band likewise extends vertically between these connection points. Preferably, niches are formed in the outer wall of the closure body and/or in the outer wall of the flap cover into which the tensioning band comes to rest in the fully closed position of the flap cover.

The flap closure can in particular be provided with one central hinge and two tensioning bands arranged on both sides of the hinge as viewed in the circumferential direction or, vice versa, one central tensioning band and two hinges arranged on both sides of the tensioning band. However, other combinations of at least one hinge and at least one tensioning band are also conceivable.

Due to the flap closure kinematics as described, when the flap cover is opened or closed, the at least one tensioning band is subject to both tensile stresses as well as—due to the flap cover rotating around the hinge axis—bending stresses.

Figure 2:
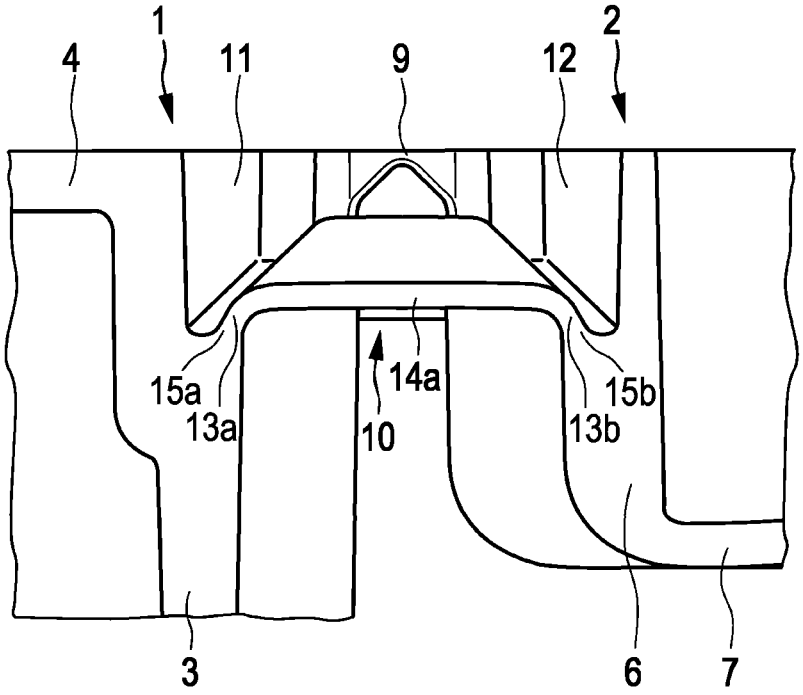
Fig. 2 (Prior Art)

In a typical prior art flap closure, as shown as an example in FIGS. 1 and 2, the tensioning band is connected to the closure body or to the flap cover respectively by two curved sections which are connected together by a flat section (or respectively a straight section in cross section). When the flap cover is pivoted, the flat section is primarily subjected to tensile stress whereas a superposition of bending stress and tensile stress occurs in the curved sections. The curved sections thus also function as bending zones or pivot points. Due to this superposition of bending and tensile stresses, the greatest states of stress ensue in these bending zones, in particular due to the bending zones being fully "straightened" upon the maximum load being applied while the flap closure is in use. In particular due to material aging, these stresses can lead to the tensioning band breaking or tearing during use as a result of environmental influences, for example cold, or as a result of user misuse. A large number of such failures can be observed in practice.

The present invention is therefore based on the task of providing a flap closure of the type as considered in which there is less breaking or tearing of the at least one tensioning band.

This task is solved by a flap closure in accordance with one of the independent claims. Advantageous embodiments of the invention are contained in the subclaims.

The flap closure as presently considered comprises a closure body and a flap cover. They are connected together by at least one hinge and by at least one tensioning band in order to achieve a snap-effect upon the opening and/or closing of the flap cover. A tensioning band is thereby understood as being a strip-shaped, preferably elastic element having two ends, wherein one end is connected to the closure body and the other end to the flap cover.

In a first inventive solution to the cited task, the at least one tensioning band in the unloaded state has at least three curved sections and a substantially straight section between each of two respectively adjacent curved sections in a cross section perpendicular to the axis of rotation of the at least one hinge, and the at least one tensioning band is not curved in opposite directions in this cross section. The latter condition means that all the curved sections in this cross section curve in the same direction; i.e. they all curve clockwise or all curve counterclockwise.

As a result, the bending stresses which occur within the tensioning band upon using the flap closure are distributed over more curved sections; i.e. over more bending zones, than if for example only two curved sections were to be provided. At the same time, the average curvature angle of the curved sections is smaller, whereby the curvature angle of a curved section is understood as being the angle by which the course of the tensioning band (in the unloaded state of the tensioning band) is deflected in cross section at this curved section. As noted above, each curved section will be pulled completely straight under maximum load on the tensioning band. Thus, the smaller the angle of curvature of an individual curved section, the less often breakage or tearing of this curved section will also occur during flap closure use.

Due to the same-direction curvature of the tensioning band, the average angle of curvature at the curved sections is also smaller than would be the case with a tensioning band having the same number of curved sections curved in different directions at said curved sections. In the first case as per the invention (curvature in the same direction), the total angle of curvature of the curved sections in cross section between the connection point of the tensioning band to the closure body and the connection point of the tensioning band to the flap cover is namely composed only of individual angles of curvature having the same preceding sign, in the second case (curvature in different directions), however, of individual angles of curvature having differing preceding signs. Thus, the individual curvature angles are on average smaller in magnitude in the first case than in the second case. As explained above, breakage or tearing of the curved section thus also occurs less frequently.

As a result of the inventive design to the curved sections of the tensioning band, breaking or tearing of the tensioning band occurs less often and the number of curved sections can concurrently be kept low. The latter simplifies the design of the tensioning band and thus—particularly given the tensioning band's very small dimensions—the fabricating of the area in the injection mold for the flap closure in which the tensioning band is formed.

A further advantage of this solution lies in the tensioning band no longer or barely projecting radially outwardly beyond the periphery of the flap closure when the flap closure is in the closed state.

In one preferential realization of this solution, the curved sections in this cross section are arranged substantially symmetrical to the center of the at least one tensioning band between the connection point of the tensioning band to the closure body and the connection point of the tensioning band to the flap cover. The loading on the tensioning band from tensile and bending stresses thereby also occurs symmetrically and therefore particularly uniformly.

However, it is also possible for the curved sections in this cross section to not be arranged substantially symmetrical to the center of the at least one tensioning band between the connection point of the tensioning band to the closure body and the connection point of the tensioning band to the flap cover.

Preferably, there is an odd number of curved sections; in particular, the number of curved sections amounts to 3, 5 or 7.

Further preferably, there is an even number of curved sections; in particular, the number of curved sections amounts to 4, 6 or 8.

In a second inventive solution to the cited task, the distance from a tangent at a center line between the edges of the at least one tensioning band at a connection point of the at least one tensioning band with the closure body and/or from a tangent at a center line between the edges of the at least one tensioning band at a connection point of the at least one tensioning band with the flap cover to the axis of rotation of the at least one hinge is at most three times, preferentially at most two times, further preferably at most equal to, and particularly preferentially at most 0.5 times the thickness of the at least one tensioning band at the respective connection point in a cross section perpendicular to the axis of rotation of the at least one hinge in the unloaded state of the at least one tensioning band in a flap closure of the type as considered.

This solution to the cited task is based on the observation that due to the flap closure's kinematics, the maximum tensile stress on the at least one tensioning band is attained when the hinge's axis of rotation lies on a straight line through the connection points of the tensioning band to the closure body or to the flap cover respectively, and in fact between these two connection points. Due to the referenced orientation of the one and/or the other connection point, there is thus no or only very low bending stress at the respective connection point when the maximum tensile stress occurs. The respective connection point is thus not additionally loaded with bending stress when the maximum tensile stress is experienced, whereby a breaking or tearing of the tensioning band, in this case at its connection points to the closure body or to the flap cover respectively, occurs less frequently.

This solution as well has a further advantage of the tensioning band no longer or barely projecting radially outwardly beyond the periphery of the flap closure when the flap closure is in the closed state.

In one particularly preferential realization of this solution, the at least one tensioning band is curved throughout in this cross section. This leads in particular to an arcuately, elliptically or otherwise curved tensioning band in cross section.

Obviously, features of the first and second inventive solution to the cited task can also be combined with one another in a flap closure, apart from the at least one tensioning band being curved throughout in cross section since the tensioning band in this case exhibits no straight sections in cross section.

Figure 3:
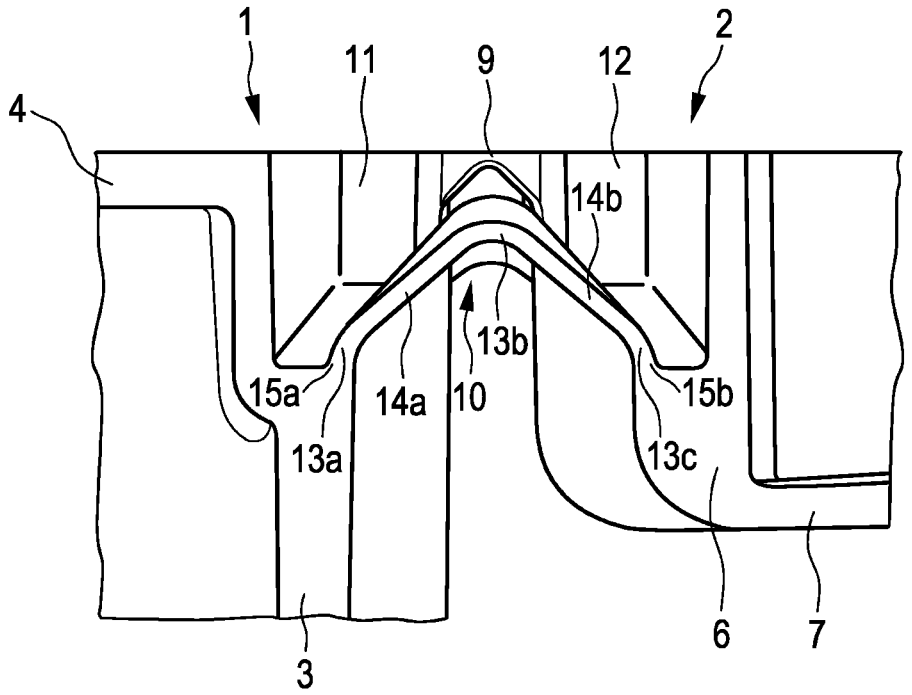
Figure 4:
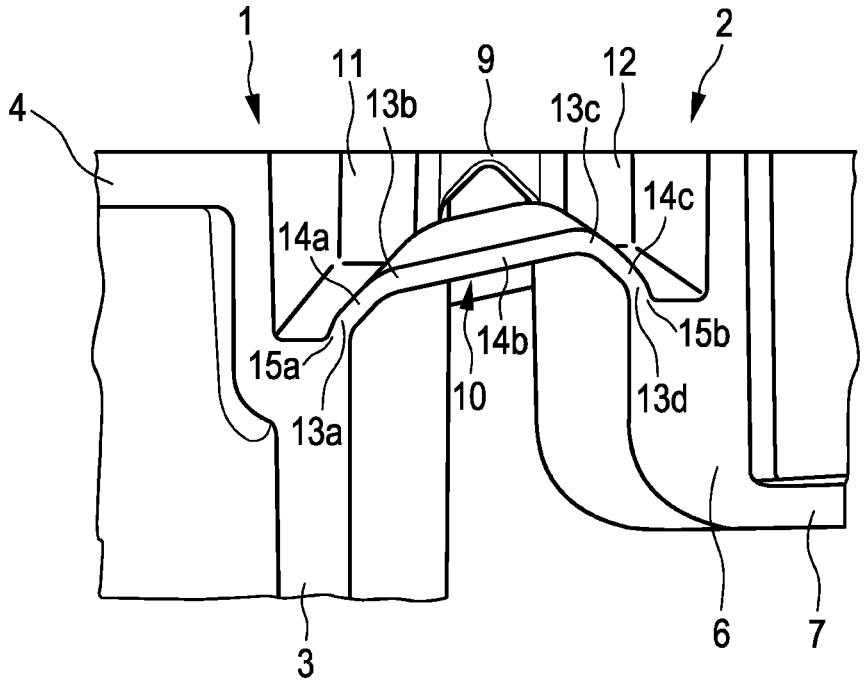
Figure 5:
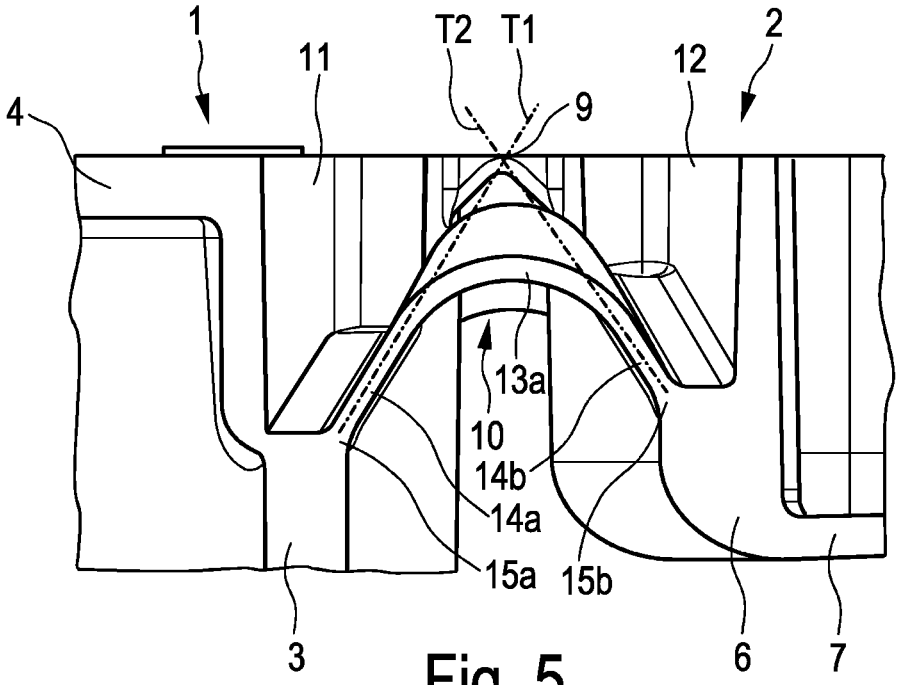
Figure 6:
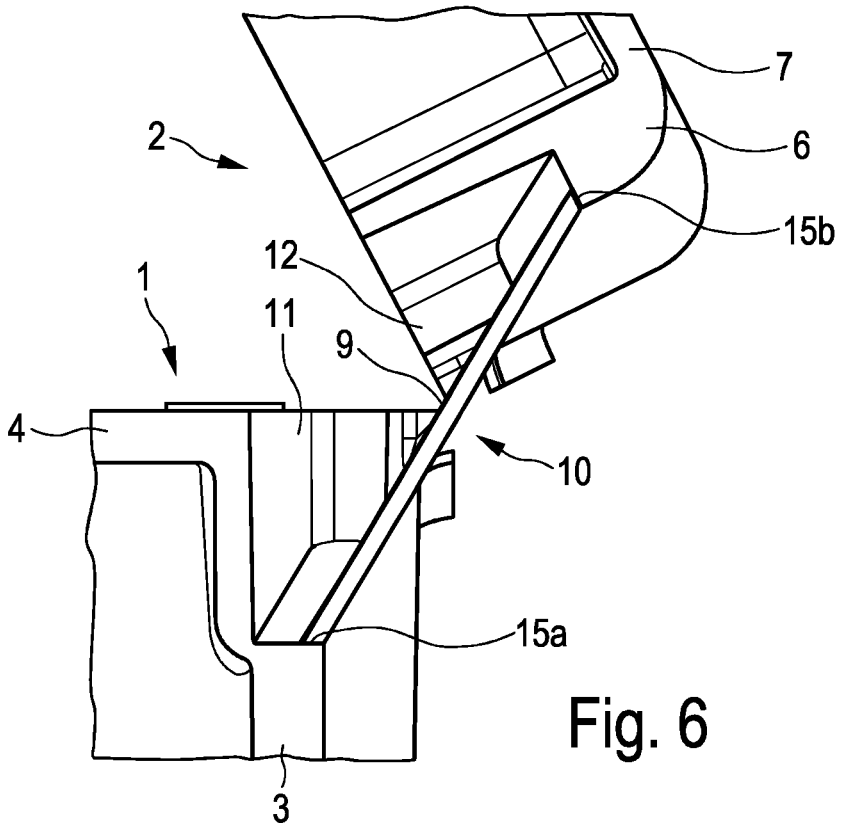
Figure 7:
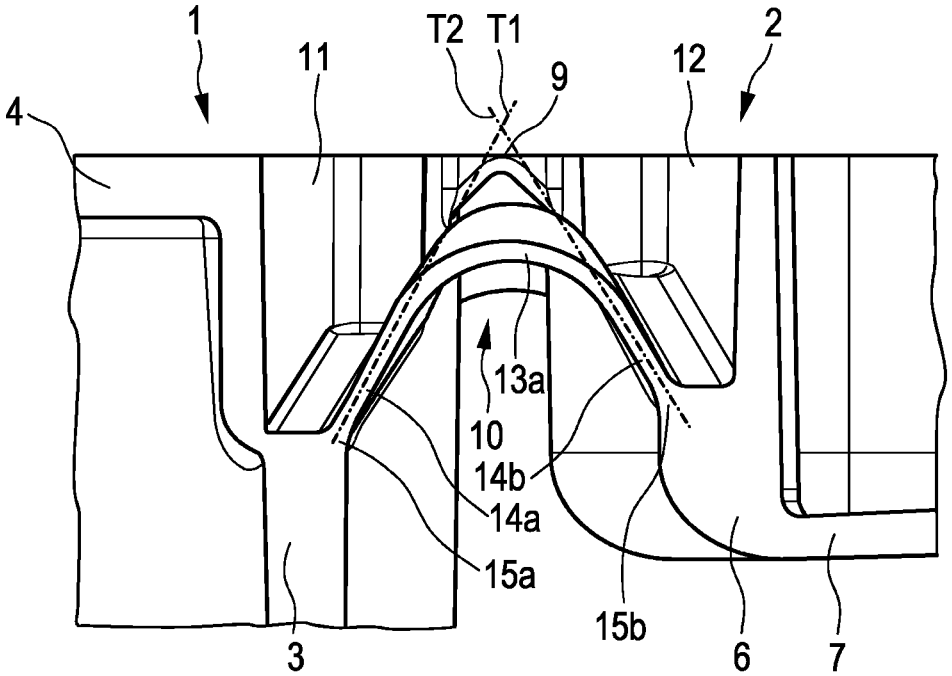
Figure 8:
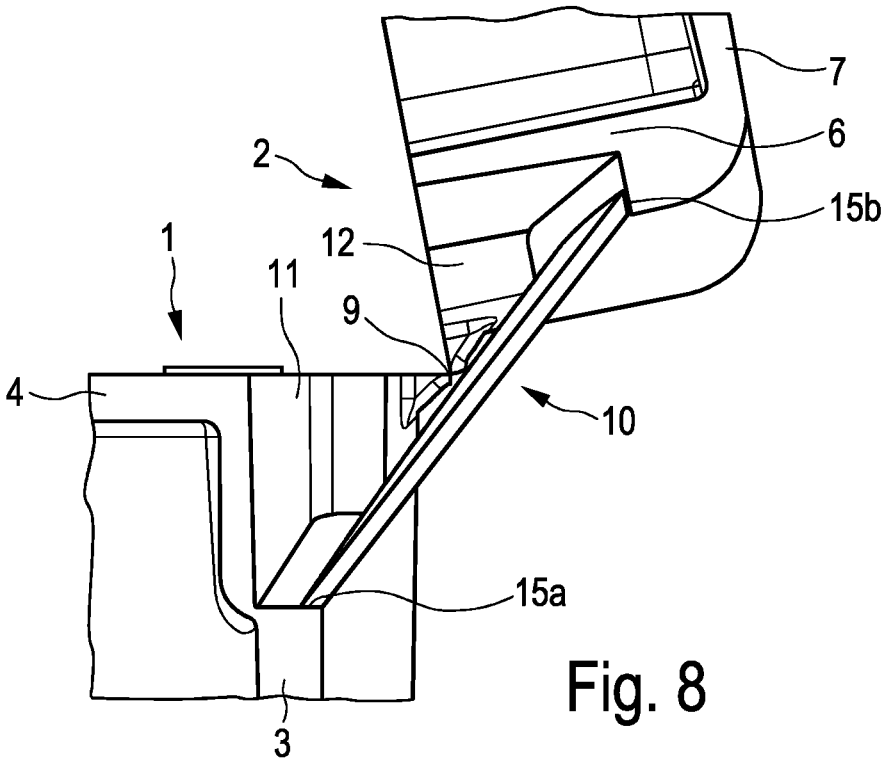

Further advantageous embodiments of the invention are depicted in the accompanying drawings in conjunction with the following description. Thereby shown are:

FIG. 1 a perspective view of a flap closure from the prior art in the injection position;

FIG. 2 a view of a tensioning band of the prior art flap closure according to FIG. 1 in a composite perspective and sectional view;

FIG. 3 a view corresponding to FIG. 2 of a tensioning band of a first realization of a flap closure according to the first solution to the task;

FIG. 4 a view corresponding to FIG. 2 of a tensioning band of a second realization of a flap closure according to the first solution to the task;

FIG. 5 a view corresponding to FIG. 2 of a tensioning band of a flap closure according to the second solution to the task;

FIG. 6 the tensioning band of the flap closure according to FIG. 5 in a partially open position of the flap closure at maximum tensile stress;

FIG. 7 a view corresponding to FIG. 2 of a further realization of a tensioning band of a flap closure according to the second solution to the task;

FIG. 8 the tensioning band of the flap closure according to FIG. 7 in a partially open position of the flap closure at maximum tensile stress.

FIG. 1 shows a perspective view of a flap closure from the prior art in the injection position, which corresponds to the position of the flap cover being opened 180 degrees. FIGS. 2 to 5 also show details from a flap closure in this position.

The flap closure according to FIG. 1 comprises a closure body 1 having a cylindrical lateral surface 3 and a closed cap surface 4 which closes off the lateral surface 3 at its upper end face. The lateral surface 3 can of course also be differently shaped, for example oval or polygonal. The cap surface 4 exhibits two sections at different heights. A dispensing opening 5 is located in the middle of the higher situated section of the cap surface 4 through which a product, for example a shower gel or a shampoo, can exit.

A connecting device is arranged on the inner side of the lateral surface 3 (not visible in FIG. 1), in particular an internal thread, by means of which the closure body 1 can be attached onto a container, particularly having a corresponding external thread. The connecting device can also be part of a snap closure, whereby the other part of the snap closure is arranged on the container. Furthermore, a seal can be arranged in the area of the connection between the closure body 1 and the container in order to prevent the leaking of product between the closure body 1 and the container.

The flap cover 2 likewise has a cylindrical lateral surface 6 of virtually the same radius as the lateral surface 3 of the closure body 1. The lower end face of the lateral surface 6 of the flap cover 2 (in the open position of the flap cover 2 as shown in FIG. 1) is closed off by a cap surface 7. A sealing plug 8 protruding into the interior of the lateral surface 6 in the middle of the cap surface 7 engages into the dispensing opening 5 and tightly seals it when the flap cover 2 is closed.

In the exemplary embodiment as depicted, the closure body 1 and the flap cover 2 are manufactured in one piece by injection molding. The pivotability of the flap cover 2 with respect to the closure body 1 is achieved by a living hinge 9 which connects the closure body 1 to the edge of the lateral surface 6 of the flap cover 2 facing away from the cap surface 7 at the height of the lower section of the cap surface 4 of the closure body 1. As clearly visible in FIG. 2, the upper edge of the lower section of the cap surface 4 of the closure body 1, the hinge 9 and the upper edge of the lateral surface 6 of the flap cover 2 (in the open position) thus lie in the same plane.

Furthermore, the closure body 1 and the flap cover 2 are connected by two tensioning bands 10 arranged on both sides of the hinge 9 in circumferential view.

FIG. 2 shows a view of one of the tensioning bands 10 of the flap closure from the prior art according to FIG. 1 in a composite perspective and sectional view, whereby the axis of the hinge 9 runs perpendicular to the image plane. The same reference numerals in the figures also signify the same flap closure elements.

The connection points 15*a*, 15*b* of the tensioning band 10 to the closure body 1 or to the flap cover 2 respectively are arranged on the respective lateral surface 3 and 6 and are thus situated lower than the plane of the hinge 9. Niches 11 and 12 are arranged in lateral surfaces 3 and 6 directly above the connection points 15*a*, 15*b* of the tensioning band 10 into which the tensioning band 10 comes to rest when the flap cover 2 is fully closed.

As can be seen in FIG. 2, the tensioning band 10 has a curved section 13*a* and 13*b* at its respective connection points 15*a*, 15*b* to the closure body 1 and to the flap cover 2. A flat or respectively straight section 14*a* in cross section extends therebetween.

When the flap cover 2 is closed from the shown open position or conversely opened from the closed position, the distance thus increases between said connection points 15*a*, 15*b* due to the arrangement of the connection points 15*a*, 15*b* of the tensioning band 10 to the closure body 1 or to the flap cover 2 respectively. The tensioning band 10 is thus stretched. The straight section 14*a* is then primarily subject to a tensile stress whereas the curved sections 13*a* and 13*b* are subject to a superposition of bending stress and tensile stress. Due to this superposition of forces, the greatest states of stress within the tensioning band 10 ensue in the curved sections 13*a* and 13*b* which are stretched fully; i.e. "straightened," upon the maximum load being applied. This can lead to the breaking or tearing of the tensioning band 10, particularly in the area of the connection points 15*a*, 15*b* to the closure body 1 or to the flap cover 2 respectively.

FIG. 3 shows a view corresponding to FIG. 2 of a tensioning band 10 of a first realization of a flap closure according to the first solution to the task. The tensioning band 10 thereby has three curved sections 13*a*, 13*b*, 13*c*, wherein a straight section 14*a* runs between curved sections 13*a* and 13*b* and a straight section 14*b* runs between curved sections 13*b* and 13*c*. The bending stresses which occur in the curved sections 13*a*, 13*b*, 13*c* are thus distributed over more curved sections and are therefore smaller per each curved section.

At the same time, the course of the tensioning band 10 from its connection point 15*a* with the closure body 1 to its connection point 15*b* with the flap cover 2 is always only curved in the same direction viewed in cross section, and that being clockwise in the view depicted in FIG. 3. The average angle of curvature at the curved sections 13*a*, 13*b*, 13*c* can thereby be kept smaller than would be with the same number of curved sections with different sections curving in opposite directions.

Due to the arrangement of the curved sections 13*a*, 13*b*, 13*c*, particularly a portion of the bending stress is shifted from the break-critical areas at the connection points 15*a*,

15*b* to the non-critical center of the tensioning band 10, whereby the bending stress at the connection points 15*a*, 15*b* is reduced.

Moreover, the tensioning band 10 does not or only barely projects radially outwardly beyond the lateral surfaces 3 and 6 in the closed state of the flap closure and is thus barely perceptible to the user.

FIG. 4 shows a view corresponding to FIG. 2 of a tensioning band 10 of a second realization of a flap closure according to the first solution to the task. The tensioning band 10 thereby exhibits four curved sections 13*a*, 13*b*, 13*c*, 13*d*, wherein straight section 14*a* runs between curved sections 13*a* and 13*b*, straight section 14*b* runs between curved sections 13*b* and 13*c*, and straight section 14*c* runs between curved sections 13*c* and 13*d*.

Due to the increased number of curved sections 13*a*, 13*b*, 13*c*, 13*d*, the bending stress in each of said curved sections 13*a*, 13*b*, 13*c*, 13*d* is further reduced.

FIG. 5 shows a view corresponding to FIG. 2 of a tensioning band 10 of a flap closure according to the second solution to the task.

The tensioning band 10 thereby exhibits a straight section 14*a*, 14*b* at the respective connection points 15*a*, 15*b* to the closure body 1 or to the flap cover 2 respectively between which runs a curved section 13*a*. The straight sections 14*a* and 14*b* are of different lengths. However, the straight sections 14*a* and 14*b* could just as easily be the same length. The straight sections 14*a* and 14*b* are connected at such an angle to the closure body 1 or to the flap cover 2 respectively that the extension of the center lines T1, T2 of the straight sections 14*a* and 14*b* (corresponding to the tangents to these center lines if they were curved sections) runs exactly or nearly exactly through the axis of the hinge 9. The distance from the respective center line T1, T2 to the axis of rotation of the hinge 9 is thus almost or exactly zero.

FIG. 6 shows the tensioning band 10 of the flap closure according to FIG. 5 in a partially open position of the flap cover 2. The opening position of the flap cover 2 is thereby selected such that the axis of the hinge 9 lies between the connection points 15*a*, 15*b* of the tensioning band 10 to the closure body 1 or to the flap cover 2 respectively. In this position, the tensile stress acting on the tensioning band 10 is at a maximum and the tensioning band 10 is fully stretched into a straight line. However, due to the described angular position of the connection points 15*a*, 15*b* of the tensioning band 10 to the closure body 1 or to the flap cover 2 respectively, no or only slight bending stresses occur at these connection points 15*a*, 15*b*. Breaking or tearing of the tensioning band 10 thus occurs less frequently at these points.

FIG. 7 shows a view corresponding to FIG. 2 of a further realization of a tensioning band 10 of a flap closure according to the second solution to the task and FIG. 8 shows the tensioning band 10 of the flap closure according to FIG. 7 in a partially open position of said flap cover 2.

The arrangement according to FIGS. 7 and 8 substantially differs from the arrangement according to FIGS. 5 and 6 in that, on the one hand, the tensioning band 10 in the stretched state (FIG. 8) does not run exactly through the axis of rotation of the hinge 9 in cross section but rather at a slight distance therefrom. On the other hand, the extension of the center lines T1, T2 of straight sections 14*a* and 14*b* does not run exactly through the axis of the hinge 9. However, the distance from the respective center line T1, T2 to the rotational axis of the hinge 9 is less than the thickness of the tensioning band 10 at the respective connection point 15*a*, 15*b*.

Otherwise, the arrangement and functioning of the tensioning band 10 in FIGS. 7 and 8 largely correspond to those of the tensioning band 10 in FIGS. 5 and 6 and will therefore not be described again.

LIST OF REFERENCE NUMERALS

1 closure body
2 flap cover
3 lateral surface of the closure body
4 cap surface of the closure body
5 dispensing opening
6 lateral surface of the flap cover
7 cap surface of the flap cover
8 sealing plug
9 hinge
10 tensioning band
11 niche in the lateral surface of the closure body
12 niche in the lateral surface of the flap cover
13*a*-13*d* curved section
14*a*-14*c* straight section
15*a*, 15*b* connection points
T1, T2 tangents

The invention claimed is:

1. A flap closure comprising:

a closure body and a flap cover which are connected to one another by at least one hinge and by at least one tensioning band in order to achieve a snap-effect upon an opening and/or closing of the flap cover, wherein a distance from a tangent at a center line between at least two edges of the at least one tensioning band at a connection point of the at least one tensioning band with the closure body and/or from a tangent at a center line between the at least two edges of the at least one tensioning band at a connection point of the at least one tensioning band with the flap cover to an axis of rotation of the at least one hinge is at most two times a thickness of the at least one tensioning band at the respective connection point in a cross section perpendicular to the axis of rotation of the at least one hinge in an unloaded state of the at least one tensioning band.

2. The flap closure according to claim 1, wherein the at least one tensioning band is curved throughout in said cross section.

3. The flap closure according to claim 1, wherein the at least one tensioning band barely projects or does not at all project radially outwardly beyond lateral surfaces in a closed state of the flap closure.

4. The flap closure according to claim 1, wherein the distance from the tangent at the center line between the at least two edges of the at least one tensioning band at the connection point of the at least one tensioning band with the closure body and/or from the tangent at the center line between the at least two edges of the at least one tensioning band at the connection point of the at least one tensioning band with the flap cover to the axis of rotation of the at least one hinge is at most equal to the thickness of the at least one tensioning band at the respective connection point in the cross section perpendicular to the axis of rotation of the at least one hinge in the unloaded state of the at least one tensioning band.

* * * * *